US012649995B1

(12) United States Patent
Barrett

(10) Patent No.: US 12,649,995 B1
(45) **Date of Patent: *Jun. 9, 2026**

(54) SPIKE STRIP

(71) Applicant: Peter Barrett, Mukilteo, WA (US)

(72) Inventor: Peter Barrett, Mukilteo, WA (US)

( * ) Notice: Subject to any disclaimer, the term of this patent is extended or adjusted under 35 U.S.C. 154(b) by 1213 days.

This patent is subject to a terminal disclaimer.

(21) Appl. No.: 17/403,713

(22) Filed: Aug. 16, 2021

Related U.S. Application Data

(63) Continuation-in-part of application No. 16/918,207, filed on Jul. 1, 2020, now Pat. No. 11,091,889, which is a continuation of application No. 16/917,149, filed on Jun. 30, 2020, now Pat. No. 11,680,378.

(51) Int. Cl.
*E01F 13/12* (2006.01)

(52) U.S. Cl.
CPC ..... *E01F 13/12* (2013.01)

(58) Field of Classification Search
None
See application file for complete search history.

(56) References Cited

U.S. PATENT DOCUMENTS

| | | | | |
|---|---|---|---|---|
| 3,456,920 | A | 7/1969 | Elivington | |
| 4,097,170 | A | 6/1978 | Dickinson | |
| 4,101,235 | A | 7/1978 | Nelson | |
| 4,158,514 | A | 6/1979 | Dickinson | |
| 4,577,991 | A | 3/1986 | Rolow | |
| 5,003,317 | A * | 3/1991 | Gray | G01S 5/04 342/465 |
| 5,452,962 | A | 9/1995 | Greves | |
| 5,498,102 | A | 3/1996 | Bissell | |
| 5,509,753 | A | 4/1996 | Thompson | |
| 5,890,832 | A | 4/1999 | Soleau | |
| 5,904,443 | A | 5/1999 | Soleau | |
| 5,975,792 | A | 11/1999 | Goeken | |
| 6,048,128 | A | 4/2000 | Jones, III et al. | |
| 6,155,745 | A | 12/2000 | Groen et al. | |
| 6,224,291 | B1 | 5/2001 | Mateychuk | |
| 6,309,137 | B1 | 10/2001 | Hirsch | |

(Continued)

FOREIGN PATENT DOCUMENTS

| | | |
|---|---|---|
| DE | 202016008008 | 3/2017 |

OTHER PUBLICATIONS

Blue Charm Beacons, BC063-iBeacon, advertisement, accessed Nov. 24, 2020, published on or before Apr. 27, 2020, pp. 1-7, USA, <https://www.amazon.com/Blue-Charm-Beacons-Water-Resistant-BC063B-iBeacon/dp/B07Z1FR6GY/>.

(Continued)

*Primary Examiner* — Christopher J Sebesta
*Assistant Examiner* — Katherine J Chu
(74) *Attorney, Agent, or Firm* — Bamert Regan PLLC

(57) ABSTRACT

Embodiments are directed toward a spike strip. The spike strip preferably includes a housing, a plurality of spikes disposed in the housing, a door, and a mover. The door is preferably configured to transition between a closed configuration in which the spikes are covered and prevented from puncturing tires of vehicles driving over the spike strip and an open configuration in which the spikes are exposed and allowed to puncture a tire of a vehicle driving over the spike strip. The mover is preferably configured to transition the door from the closed configuration to the open configuration responsive to a signal provided to the spike strip from a remote location.

18 Claims, 13 Drawing Sheets

(56) References Cited

U.S. PATENT DOCUMENTS

| | | | | |
|---|---|---|---|---|
| 6,474,903 | B1 | 11/2002 | Marts | |
| 6,650,283 | B2 | 11/2003 | Brydges | |
| 6,821,050 | B1 | 11/2004 | Maldonado | |
| 7,011,470 | B1 | 3/2006 | Breazeale | |
| 7,025,526 | B2 | 4/2006 | Blair | |
| 7,179,015 | B1 | 2/2007 | Rittenhouse | |
| 7,201,531 | B2 | 4/2007 | Shackelford | |
| 7,210,875 | B1 | 5/2007 | Christle | |
| 7,275,889 | B1 | 10/2007 | McGill | |
| 7,321,305 | B2 * | 1/2008 | Gollu | G06Q 10/087 705/28 |
| 8,147,163 | B2 | 4/2012 | Bare et al. | |
| 8,418,624 | B2 | 4/2013 | McGarraugh | |
| 8,469,627 | B2 | 6/2013 | Castro | |
| 8,506,203 | B2 | 8/2013 | Spencer et al. | |
| 9,133,589 | B2 | 9/2015 | Ball | |
| 9,297,128 | B1 | 3/2016 | Tang | |
| 9,416,506 | B2 | 8/2016 | Castro | |
| 9,489,813 | B1 * | 11/2016 | Beigel | G08B 13/2417 |
| 9,702,100 | B2 | 7/2017 | Castro | |
| 10,106,940 | B1 | 10/2018 | Tang | |
| 10,301,786 | B2 | 5/2019 | Sullivan et al. | |
| 10,408,557 | B2 | 9/2019 | Verdino et al. | |
| 10,645,200 | B2 * | 5/2020 | Gil | G06F 13/128 |
| 2014/0199118 | A1 | 7/2014 | Wersching et al. | |
| 2014/0227031 | A1 | 8/2014 | Fifi | |
| 2015/0252540 | A1 | 9/2015 | Lee | |
| 2017/0183204 | A1 | 6/2017 | Zelinsky | |
| 2018/0122202 | A1 * | 5/2018 | Brantley | A44C 7/003 |
| 2018/0165945 | A1 * | 6/2018 | McClendon | G01S 19/17 |
| 2019/0194887 | A1 | 6/2019 | Kim | |
| 2020/0202292 | A1 * | 6/2020 | Doig | G01S 5/0027 |
| 2020/0364951 | A1 * | 11/2020 | Riley | G08G 1/096758 |

OTHER PUBLICATIONS

Feasycom, eddystone ibeacon, advertisement, accessed Nov. 24, 2020, published on or before Apr. 27, 2020, pp. 1-10, USA, <https://www.amazon.com/programmable-Battery-Bluetooth-eddystone-Technology/dp/B078N2B7RD/>.

Tile, tile sticker, advertisement, accessed Nov. 24, 2020, published on or before Apr. 27, 2020, pp. 1-12, USA, <https://www.amazon.com/Tile-RE-25004-Sticker-4-Pack/dp/B07W4XYTPY/>.

The Bit, tracker, advertisement, accessed Nov. 24, 2020, published on or before Apr. 27, 2020, pp. 1-7, USA, <http://findmybit.com/>.

Chipolo, https://chipolo.net/en/blogs/difference-between-bluetooth-trackers-and-gps-trackers.

Sensolus, Jan. 17, 2019 https://www.sensolus.com/four-geolocaton-technologies-compared-how-can-they-improve-your-operational-efficiency/ (Year:2019).

Apple's AirTag Relies on a Feature No Competitor Can Match: 1 Billion iPhones, CNBC Tech, assessed Aug. 16, 2021, published on Apr. 21, 2021, Updated on Apr. 22, 2021, 8 pages, <https://www.cnbc.com/2021/04/21/apple-airtag-relies-on-massive-iphone-installed-base.html?_ source=sharebar|email&par=sharebar>.

* cited by examiner

SPIKE STRIP

CROSS-REFERENCE TO RELATED APPLICATIONS

This patent application is a continuation-in-part of U.S. patent application Ser. No. 16/918,207, entitled "SPIKE STRIP," filed on Jul. 1, 2020, which is a continuation of U.S. patent application Ser. No. 16/917,149, entitled "SPIKE STRIP," filed Jun. 30, 2020, the entirety of each of which is hereby incorporated herein by reference.

FIELD OF THE INVENTION

The invention relates generally to spike strips and, more particularly, to remotely deployable spike strips.

BACKGROUND OF THE INVENTION

Fleeing vehicles pose a significant danger to the public because drivers of such fleeing vehicles often use any means necessary to avoid capture, and law enforcement officers ("LEOs") that engage in vehicle pursuit are often committed to such pursuit until it culminates in capture of the fleeing driver or other inhabitants of such fleeing vehicles. Spike strips are used to disable or impede the use of vehicles fleeing LEOs. Traditional spike strips require a LEO to wait beside a road on which a fleeing vehicle is traveling and, just before the vehicle passes the LEO, throw the spike strips onto the road. LEOs are struck by vehicles every year during the deployment process or immediately thereafter, such as by vehicles swerving to avoid the spike strips. The LEO cannot deploy the spike strips earlier because innocent people's vehicles would be damaged. Accordingly, deploying traditional spike strips poses great danger to LEOs.

Some attempts have been made to provide remotely deployable spike strips, but the known attempts have significant drawbacks. Some are single use. Others have large moving pieces when deployed that catch the eyes of drivers of fleeing vehicles. Some make loud noises when deployed, which also catch the attention of such drivers. After deployment, the spike strips pose a danger for innocent drivers of vehicles that arrive after the fleeing vehicle. Others are tedious to store after deployment. Some have a high chance of snagging objects on the spikes in their undeployed configuration. Moreover, fleeing vehicles may travel great distances after driving over spike strips, thereby making it difficult to find the drivers of such vehicles.

SUMMARY OF THE INVENTION

It is therefore an object of the present invention to provide spike strips that are remotely deployable.

It is also an object of the present invention to provide spike strips that achieve the above object and that also inconspicuously deploy.

It is another object of the present invention to provide spike strips that achieve the above objects and that also quietly deploy.

It is a further object of the present invention to provide spike strips that achieve the above objects and that also decrease the danger posed to innocent drivers arriving at the location of the spike strips after fleeing vehicles.

It is yet another object of the present invention to provide spike strips that achieve the above objects and that also are easily storable.

It is also an object of the present invention to provide spike strips that achieve the above objects and that facilitate safe storage without snagging other objects on the spikes of the spike strips.

It is another an object of the present invention to provide spike strips that achieve the above objects and that facilitate tracking vehicles that have driven over the spike strips.

The invention achieves the above objects, as well as other objects and advantages that will become apparent from the description that follows, by providing a spike strip. The spike strip preferably includes a first housing, a plurality of first spikes disposed in the first housing, a first door, and a first mover. The first door is preferably configured to transition between a closed configuration in which the first spikes are covered and prevented from puncturing tires of vehicles driving over the spike strip and an open configuration in which the first spikes are exposed and allowed to puncture a first tire of a vehicle driving over the spike strip. The first mover is preferably configured to transition the first door from the closed configuration to the open configuration responsive to a signal provided to the spike strip from a remote location.

The spike strip preferably has a plurality of spike trackers coupled to the first spikes. In some versions, the first spikes and the spike trackers are configured to couple to the punctured first tire. The spike trackers are preferably configured to communicate location information to a computer to facilitate tracking the vehicle having the punctured first tire. In some versions, the computer is mobile device such as a cellular telephone or a computer in an LEO vehicle (i.e., the spike trackers include wireless personal area network beacons with signals provided to the computer). In other versions, the computer is a flying drone that automatically follows the trackers and relays the location information to the mobile device (i.e., the spike trackers include wireless local area network beacons with signals relayed through a drone). In some versions, the spike trackers are configured to emit signals that are receivable by nearby third-party computers within signal range, such as mobile devices including cellular telephones, and the signal is configured to cause the receiving third-party computers to transmit a message (for example over the internet, WI-FI, or a cellular network) to the computer to facilitate tracking the vehicle. In some versions, the signal from the spike tracker omits location identification information and instead includes tracker-identification information, and the third-party computer determines and provides its own location information to the computer, which enables the computer to determine that the spike tracker is located near the third-party computer (i.e., within the typical signal range for the standard utilized by the spike tracker, such as a BLUETOOTH standard).

The first door is preferably configured to slide along a top of the first housing to transition between the closed configuration and the open configuration. In other versions, the first door is pivotably coupled to the top of the first housing by a hinge.

The first housing, plurality of first spikes, first door, and first mover preferably define a first spike-strip module. The spike strip preferably includes a second spike-strip module that includes a second housing, a plurality of second spikes disposed in the second housing, a first door, and a second mover. The second door is preferably configured to transition between a closed configuration in which the second spikes are covered and prevented from puncturing tires of vehicles driving over the spike strip and an open configuration in which the second spikes are exposed and allowed to puncture a second tire of the vehicle driving over the spike strip. The second mover is preferably configured to transition the second door from the closed configuration to the open configuration responsive to the signal provided to the spike strip from the remote location. The second spike-strip module is preferably moveably coupled to the first spike-strip module to facilitate transitioning the spike strip between a collapsed configuration that facilitates storing the spike strip in a vehicle trunk and an expanded configuration that facilitates the spike strip extending across at least one vehicle lane. In some versions, the second spike-strip module is pivotably coupled to the first spike-strip module to facilitate stacking the second spike-strip module on the first spike-strip module in the collapsed configuration.

The first spikes preferably elevate to protrude out of the first housing as or after the first door transitions to the open configuration and retract back into the first housing as or before the first door transitions to the closed configuration.

The spike strip preferably has a gear driven by the mover. The gear is preferably configured to transition the first door between the closed configuration and the open configuration. In some versions, the gear is configured to elevate the first spikes to protrude out of the housing as or after the first door transitions to the open configuration. In some versions, the gear is configured to retract the first spikes back into the first housing as or before the first door transitions to the closed configuration. In some versions, the spike strip has an elevating mechanism configured to elevate the first spikes to protrude out of the housing as or after the first door transitions to the open configuration. In some versions, the spike strip has a fin extending downward from the first door. The fin is preferably configured to retract the first spikes back into the first housing as or before the first door transitions to the closed configuration. In some versions, the elevating mechanism includes a spring that biases the first spikes toward protruding out of the housing.

The spike strip preferably has a warning light that is configured to illuminate or flash after the first spikes puncture the first tire of the vehicle to facilitate warning subsequently arriving vehicles. The housing preferably has a side that is inwardly inclined to define a ramp region. The ramp region is preferably configured to face oncoming traffic and guide vehicle tires toward a top of the housing. In some versions, the warning light is disposed in the ramp region of the housing.

The spike strip preferably has control circuitry that is configured to receive the signal from the remote location. The signal from the remote location is preferably a wireless signal. The control circuitry is preferably configured to cause the first mover to transition the first door from the closed configuration to the open configuration responsive to the wireless signal.

The first mover is preferably configured to automatically transition the first door from the open configuration to the closed configuration responsive to a determination that a predetermined amount of time has lapsed after a determination that at least one of the first spikes separated from the spike strip. In some versions, the determinations are made by the control circuitry, and the control circuitry preferably sends a control signal to the first mover to cause such automatic transition responsive to such determinations.

BRIEF DESCRIPTION OF THE DRAWINGS

Preferred embodiments of the present invention are described in detail below with reference to the following drawings.

DETAILED DESCRIPTION OF THE PREFERRED EMBODIMENT

Figure 1:
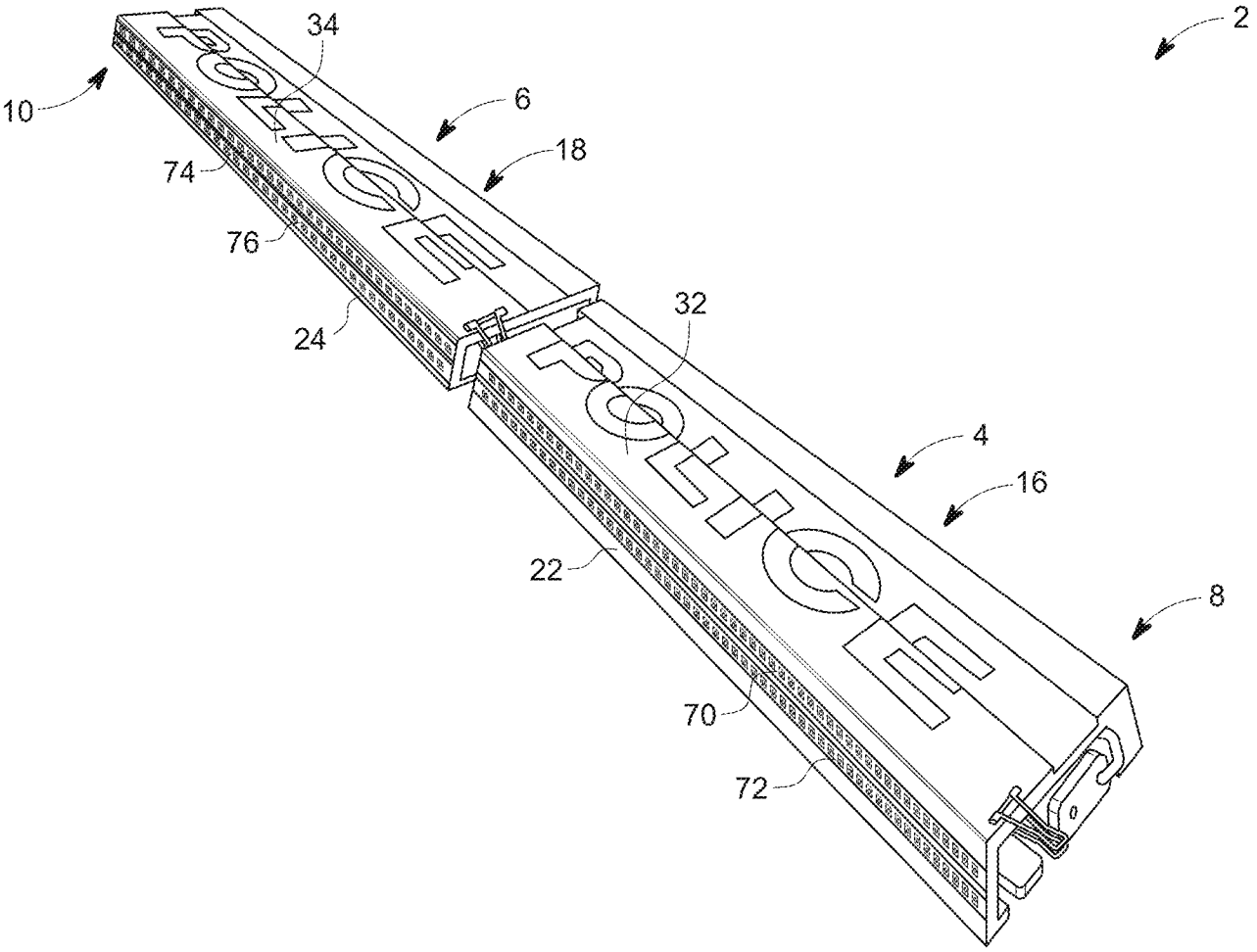
FIG. 1 is a front-left perspective view of a preferred spike strip in an expanded configuration.
Figure 2:
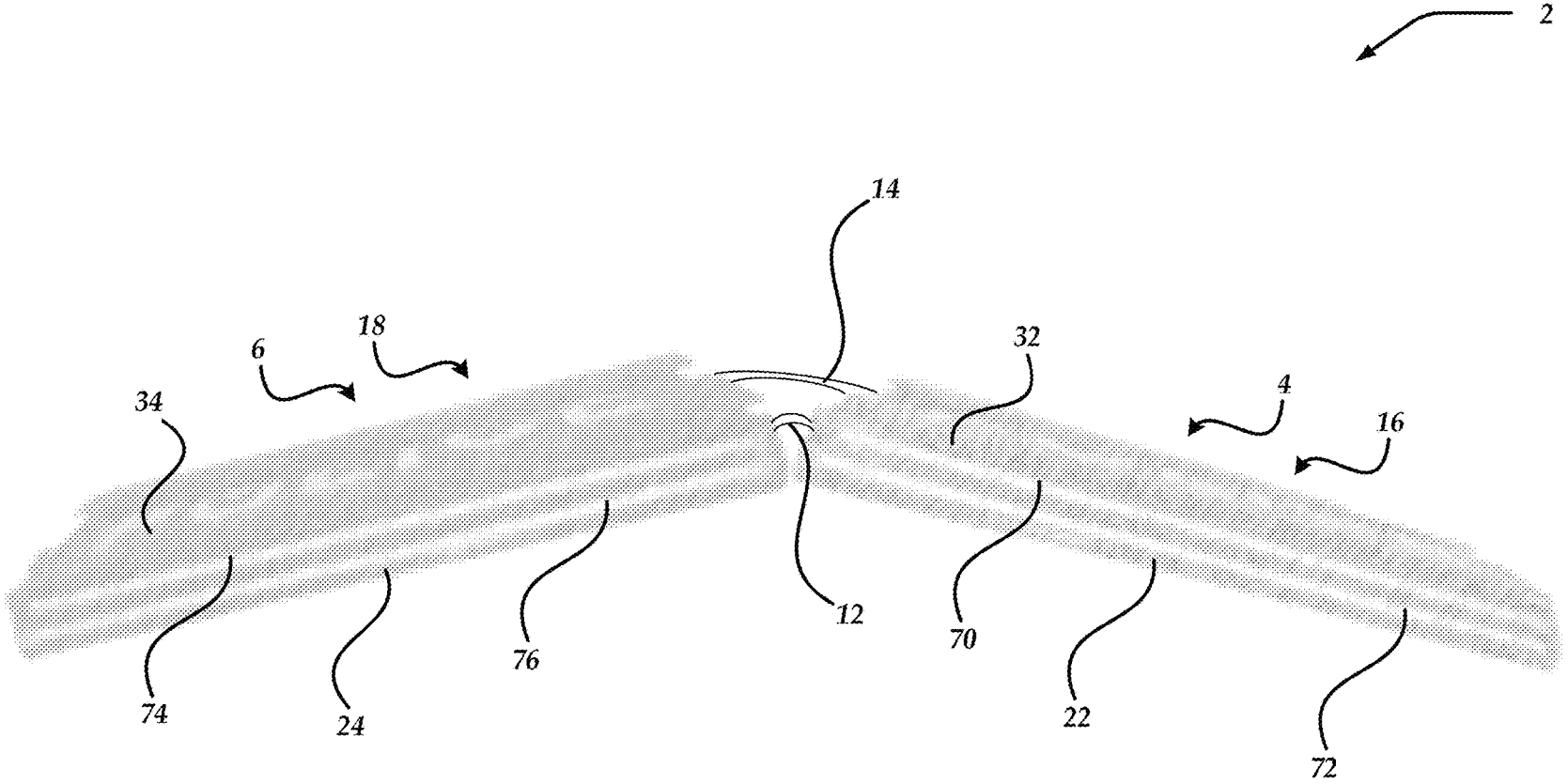
FIG. 2 is a front elevational view of the spike strip of FIG. 1 during a transition between the expanded configuration and a collapsed configuration.
Figure 3:
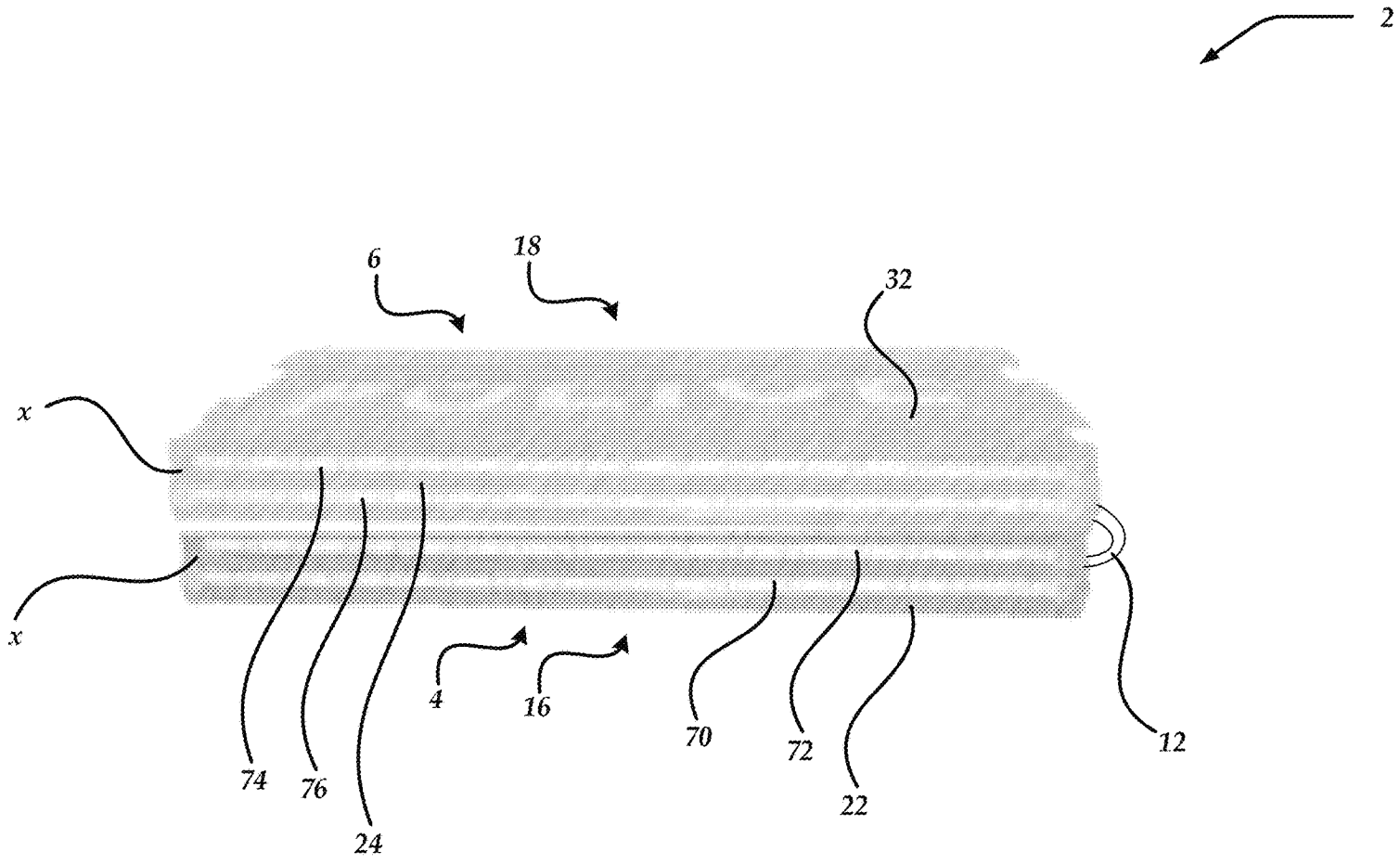
FIG. 3 is a front elevational view of the spike strip of FIG. 1 in a collapsed configuration.
Figure 4:
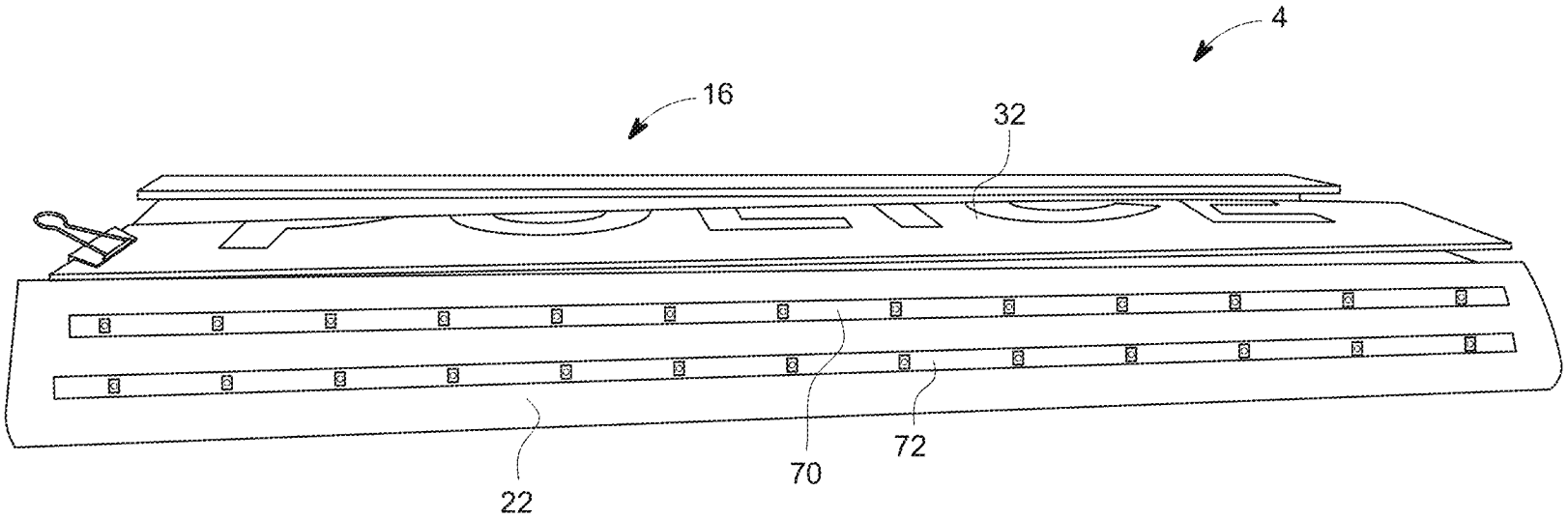
FIG. 4 is a front elevational view of a spike-strip module of the spike strip of FIG. 1.
Figure 5:
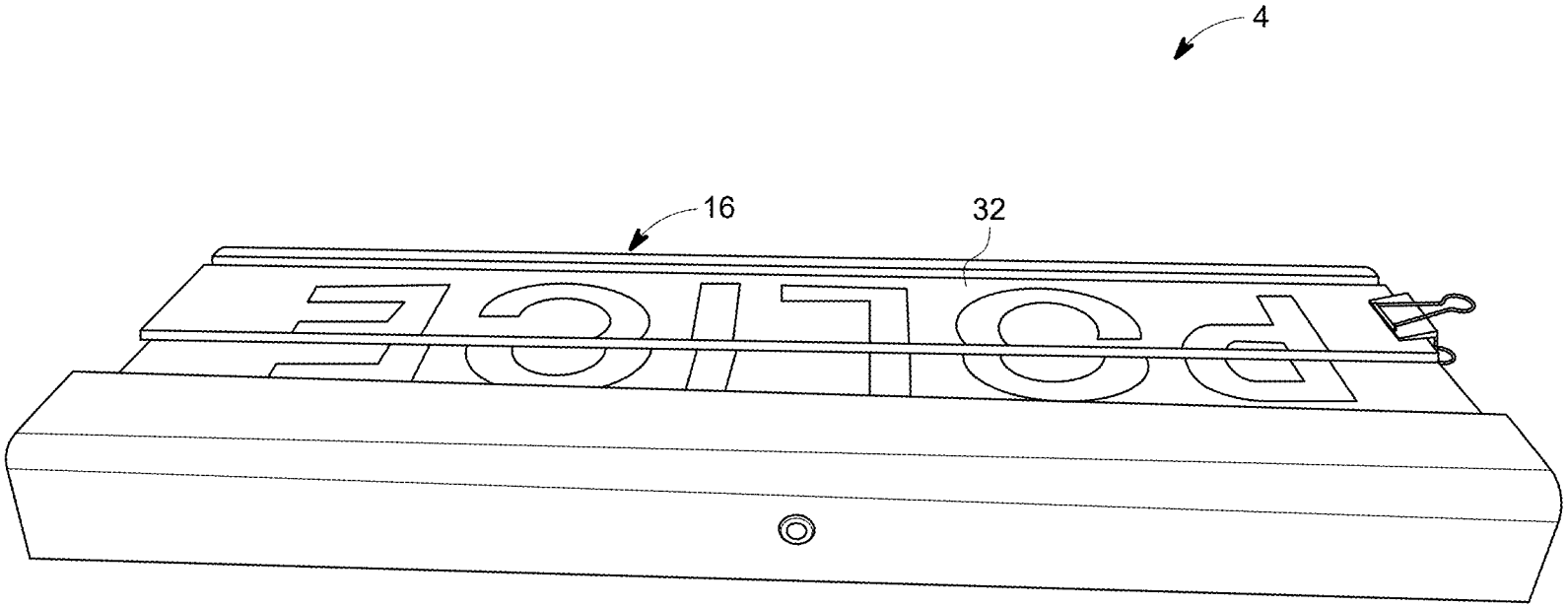
FIG. 5 is a rear perspective view of the spike-strip module of FIG. 4.
Figure 6:
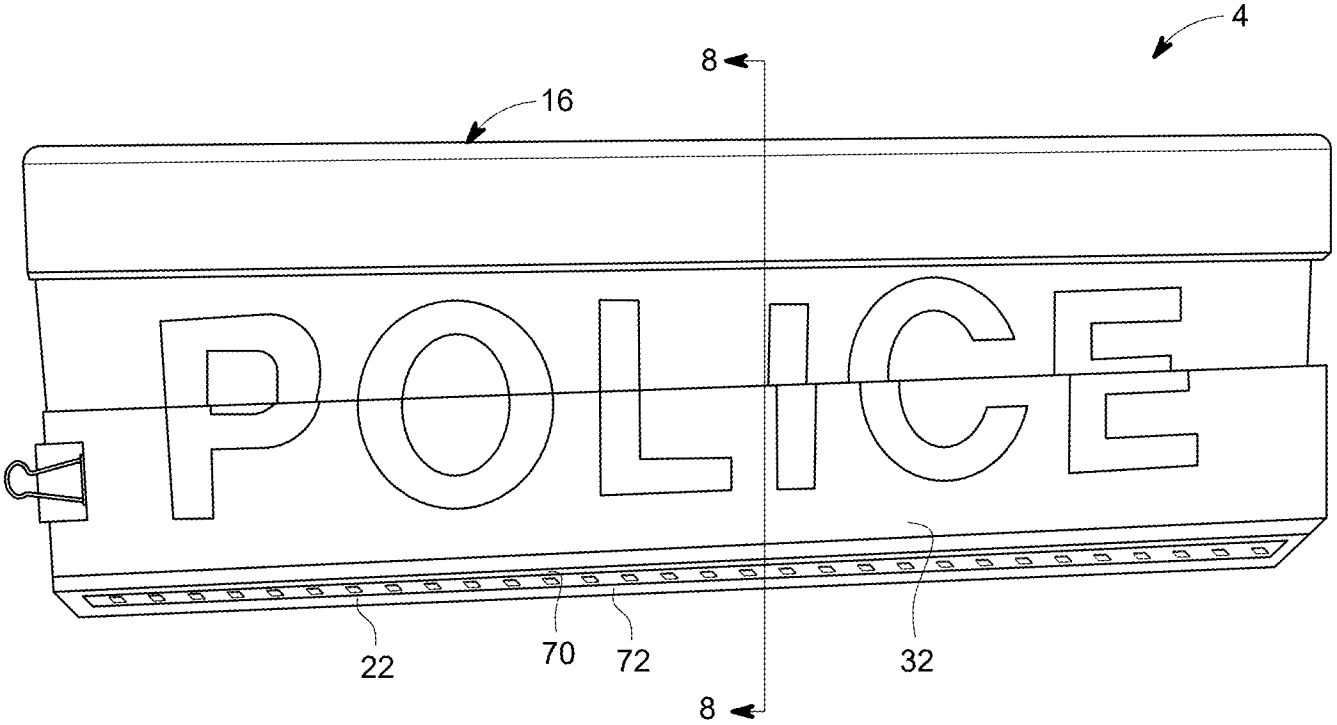
FIG. 6 is an overhead plan view of the spike-strip module of FIG. 4 in an undeployed configuration.

A preferred spike strip 2 in accordance with the principles of the invention is shown in FIG. 1. As shown in FIG. 1, the spike strip 2 is in an undeployed, expanded configuration that preferably facilitates the spike strip 2 extending across at least one standard vehicular traffic lane while allowing vehicles to drive over the spike strip 2 without the spike strip 2 damaging such vehicles. The spike strip 2 is preferably approximately 8 feet long in the expanded configuration. The spike strip 2 preferably includes multiple spike-strip modules, such as a first module 4 and a second module 6, arranged in a row along the length of the spike strip 2 from the left end portion 8 to the right end portion 10. Each module is preferably moveably (for example, pivotably) coupled to the adjacent module(s) in the row (see FIG. 2). Accordingly, the spike strip 2 preferably facilitates transitioning between the expanded configuration and a collapsed configuration (see FIG. 3) that facilitates storing the spike strip 2 in the trunk of a vehicle, such as a police cruiser. The modules are preferably hingeably coupled to each other with one or more tethers, such as tethers 12, 14, that extend between adjacent modules (see FIG. 2). In the collapsed configuration (see FIG. 3), the tethers 12, 14 are preferably configured to provide handles for carrying the spike strip 2.

Figure 7:
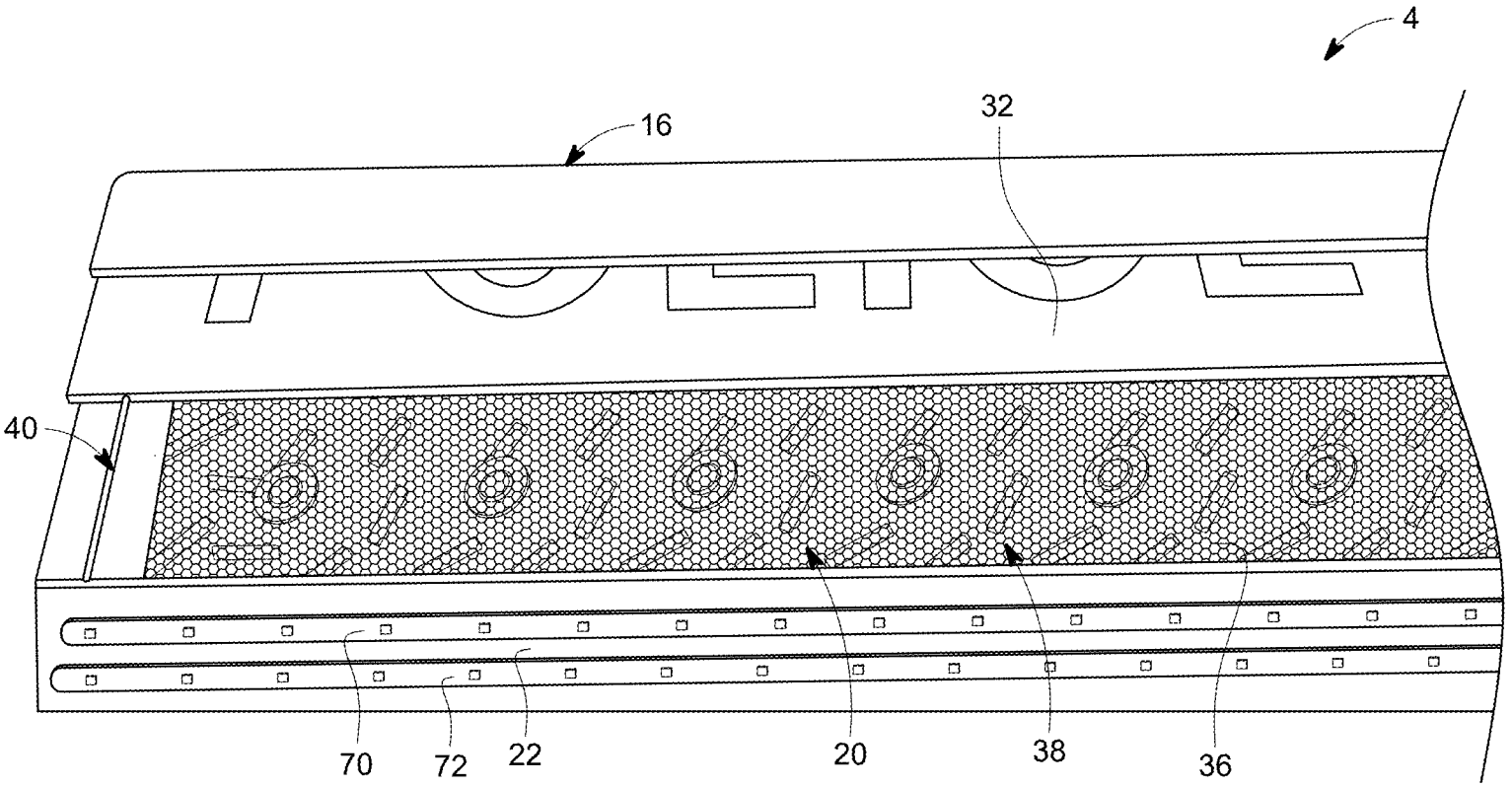
FIG. 7 is an overhead plan view of the spike-strip module of FIG. 4 in a deployed configuration.

Each spike-strip module 4, 6 preferably includes a housing 16, 18. Each housing 16, 18 is generally configured as a traffic calming device, such as a speed table or, as shown in the drawings, a speed bump. Each housing 16, 18 preferably houses deployable, retractable spikes, such as the schematically represented spikes 20 shown in FIG. 7. The front face of each spike-strip module 4, 6 is preferably inwardly inclined to define a ramp region 22, 24 that is configured to face opposite the direction of travel in a lane in which the spike strip 2 is disposed (i.e., face toward oncoming traffic) and thereby guide a passing vehicle's tires to the top of the housing 16, 18. Each housing 16, 18 preferably includes a spike door 32, 34 that is configured to cover the spikes 20 when the door 32, 34 is closed in the undeployed configuration (see FIG. 1) and to expose the spikes 20 when the door 32, 34 is open in the deployed configuration (see FIG. 7). Each spike door 32, 34 preferably covers a spike opening 38 in the closed configuration and exposes the spike opening 38 in the open configuration. The spikes 20 are preferably configured to extend through the spike opening 38 as or after the door 32, 34 transitions to the open configuration and are configured to retract back inside the housing 16, 18 as or before the door 32, 34 transitions to the closed configuration. In other versions, each housing 16, 18 is devoid of a spike door, and a portion of the housing 16, 18 is defined by a grate or mesh structure 36 (see FIG. 7) that has openings large enough for the spikes 20 to extend through the structure 36 and retract back into the housing 16, 18.

The door 32, 34 preferably slides along the top of the housing 16, 18 to transition between the open configuration and the closed configuration. At least one coupler (not shown) preferably slidingly couples the door 32, 34 to the housing 16, 18. The coupler preferably includes a substantially vertical shaft and a flange that is transverse to the shaft. The coupler is preferable shaped like an upside-down T. The shaft preferably couples to the underside of the door 32, 34 and through a channel 40 defined by the housing (see FIG. 7) with the transverse flange being disposed inside the housing (i.e., opposite the portion of the housing that defines the channel 40 from the door 32, 34). In the version shown in FIG. 7, another channel and coupler are preferably similarly arranged on the opposite end portion of the housing 16. In other versions, the housing 16, 18 includes walls that extend upward above the door 32, 34 and inwardly extending flanges 26, 28 at the tops of the walls with the door 32, 34 disposed between the flanges 26, 28 and the rest of the housing 16, 18, thereby securing the door 32, 34 (see FIG. 12). In some versions, tabs (not shown) extend downward from the front and rear ends of the flanges 26, 28 to secure the door 32, 34 in the forward and rearward directions. Accordingly, the housing 16, 18 is preferably slidably coupled to the top of the housing 16, 18. In other versions, the door 32, 34 pivots about a hinge (not shown) to transition between the open configuration and the closed configuration. In versions with a hinged door, the door preferably has a magnet strip on its top surface as viewed in the closed configuration, and the housing preferably has a corresponding magnetic strip on the opposite side of the hinge to facilitate securing the door in the open configuration when the magnet on the door makes contact with the magnet on the housing. In some versions, the hinged door has spikes disposed on its inner surface in the closed configuration to facilitate exposing those spikes when the door transitions to the open configuration.

Figure 8:
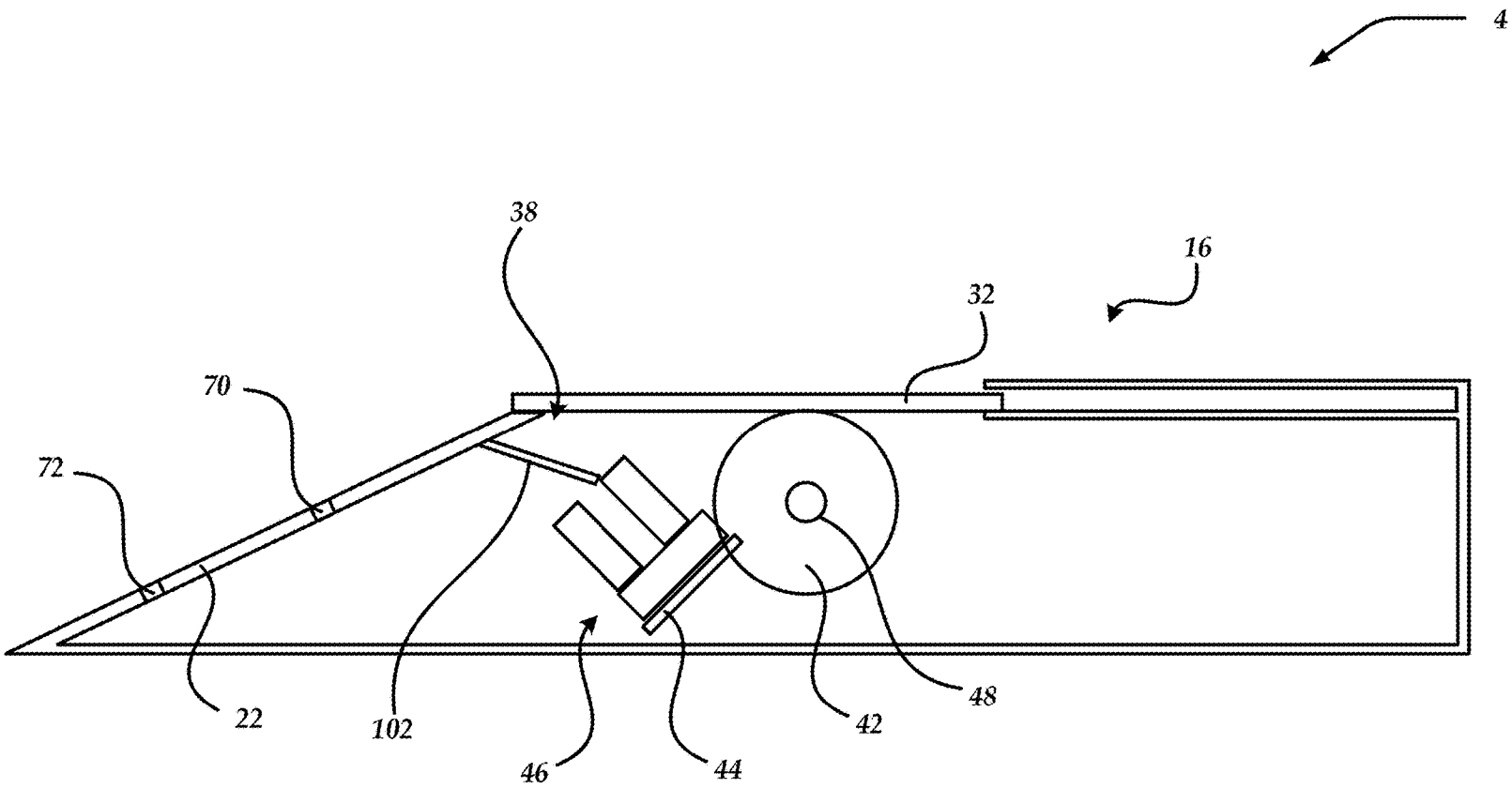
FIG. 8 is a cross-sectional schematic view of the spike-strip module of FIG. 4 in the undeployed configuration, taken along line 8-8 in FIG. 6.
Figure 9:
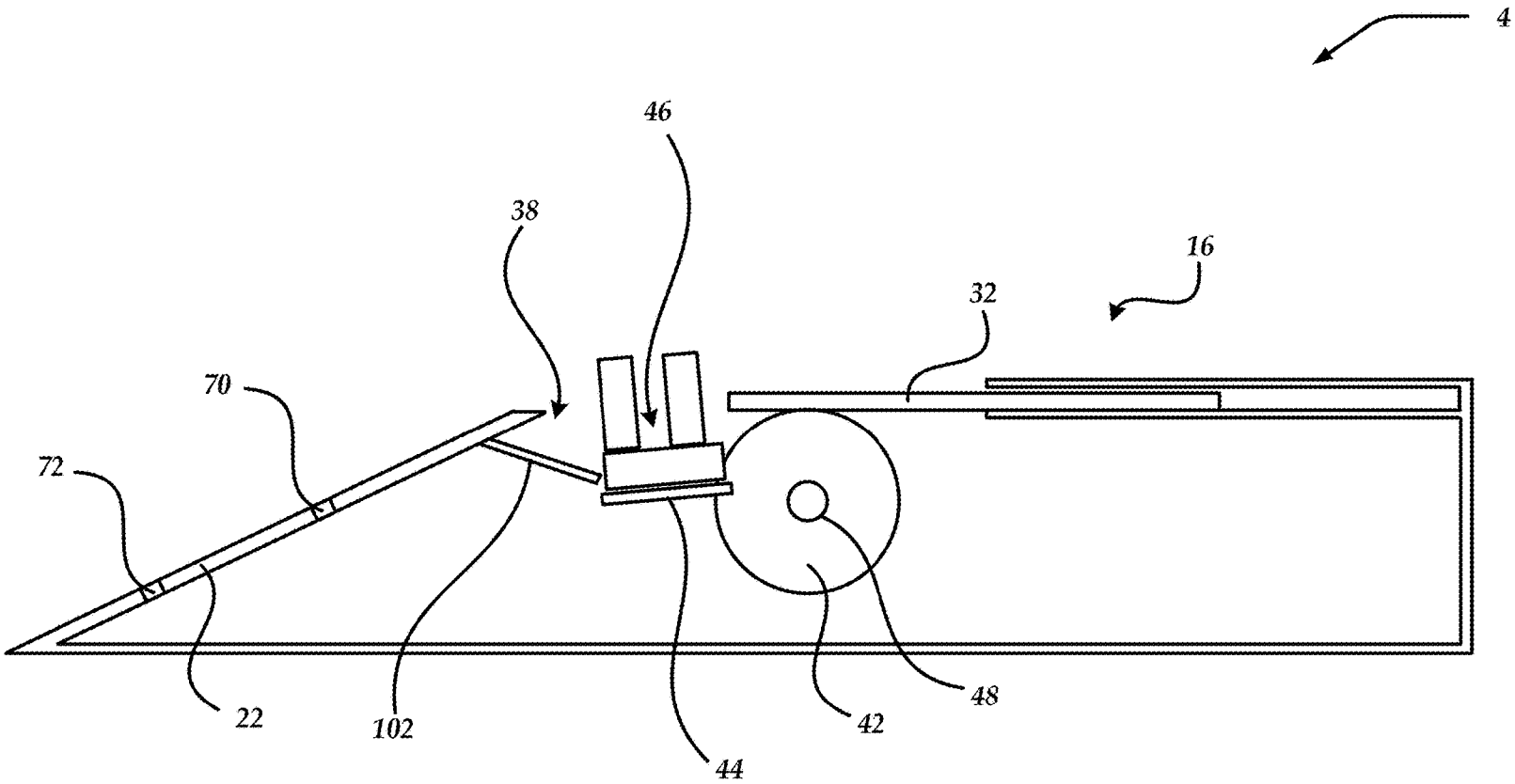
FIG. 9 is a cross-sectional schematic view of the spike-strip module of FIG. 4 in the deployed configuration, taken along line 8-8 in FIG. 6.

The door 32, 34 is preferably driven between the open configuration and the closed configuration with a linear actuator, such as a rack and pinion. Each housing 16, 18 preferably houses a circular gear or pinion 42 that engages a linear gear or rack 9 (not shown) disposed on or in the door 32, 34 (see FIG. 8). At least one spike platform, such as the platform 44 in FIG. 8, is configured to hold one or more spike assemblies, such as the spike-tracker assembly 46. The spike platform 44 is preferably elevated or lowered to transition between the deployed and undeployed configurations. The spike platform 44 is preferably coupled to the actuator that drives the door 32, 34, such as the pinion 42 or an axle 48 that rotates with the pinion 42. Accordingly, as the door 32, 34 slides open or closed, the spike platform 44 raises or lowers to transition between the undeployed configuration and the deployed configuration (contrast FIGS. 8 and 9). In some versions, the gear 42 couples to the door 32, 34 or the spike platform 44 with an arm (not shown) that extends substantially radially outward from the gear toward the door 32, 34 or the spike platform 44 and thereby moves the door 32, 34 or the spike platform 44.

Figure 10:
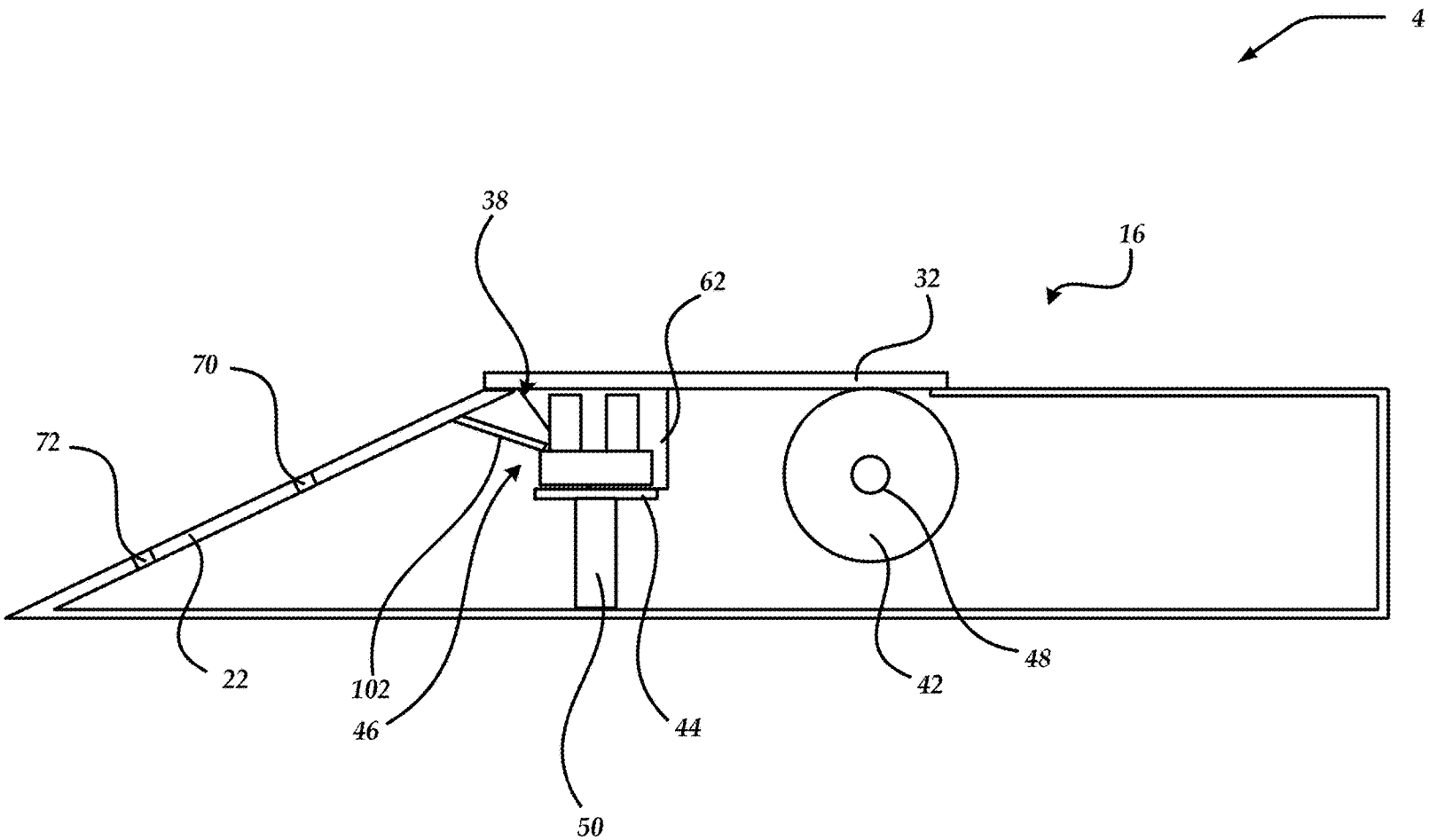
FIG. 10 is a cross-sectional schematic view of another preferred spike-strip module in an undeployed configuration.
Figure 11:
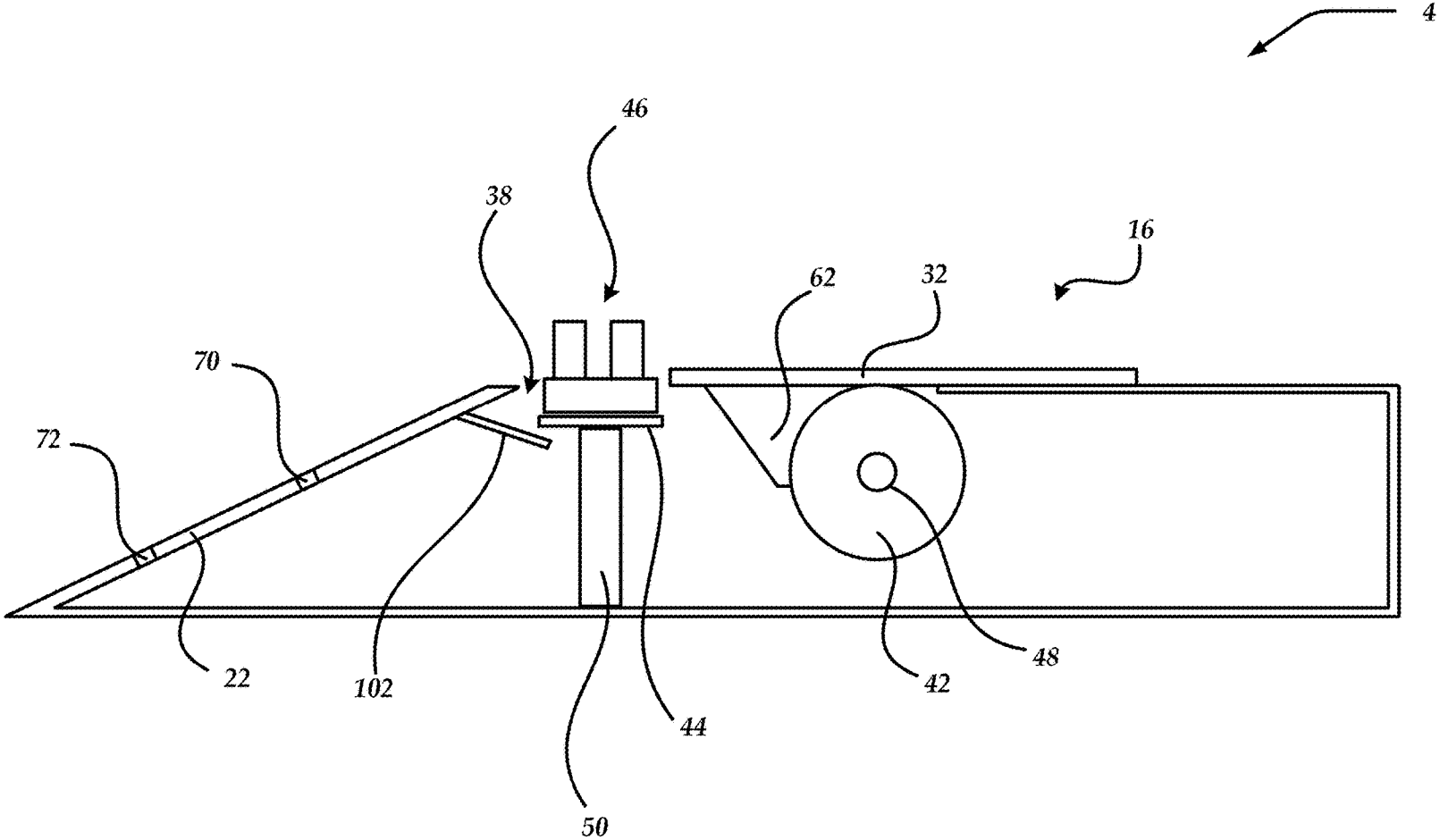
FIG. 11 is a cross-sectional schematic view of the spike-strip module of FIG. 10 in a deployed configuration.
Figure 12:
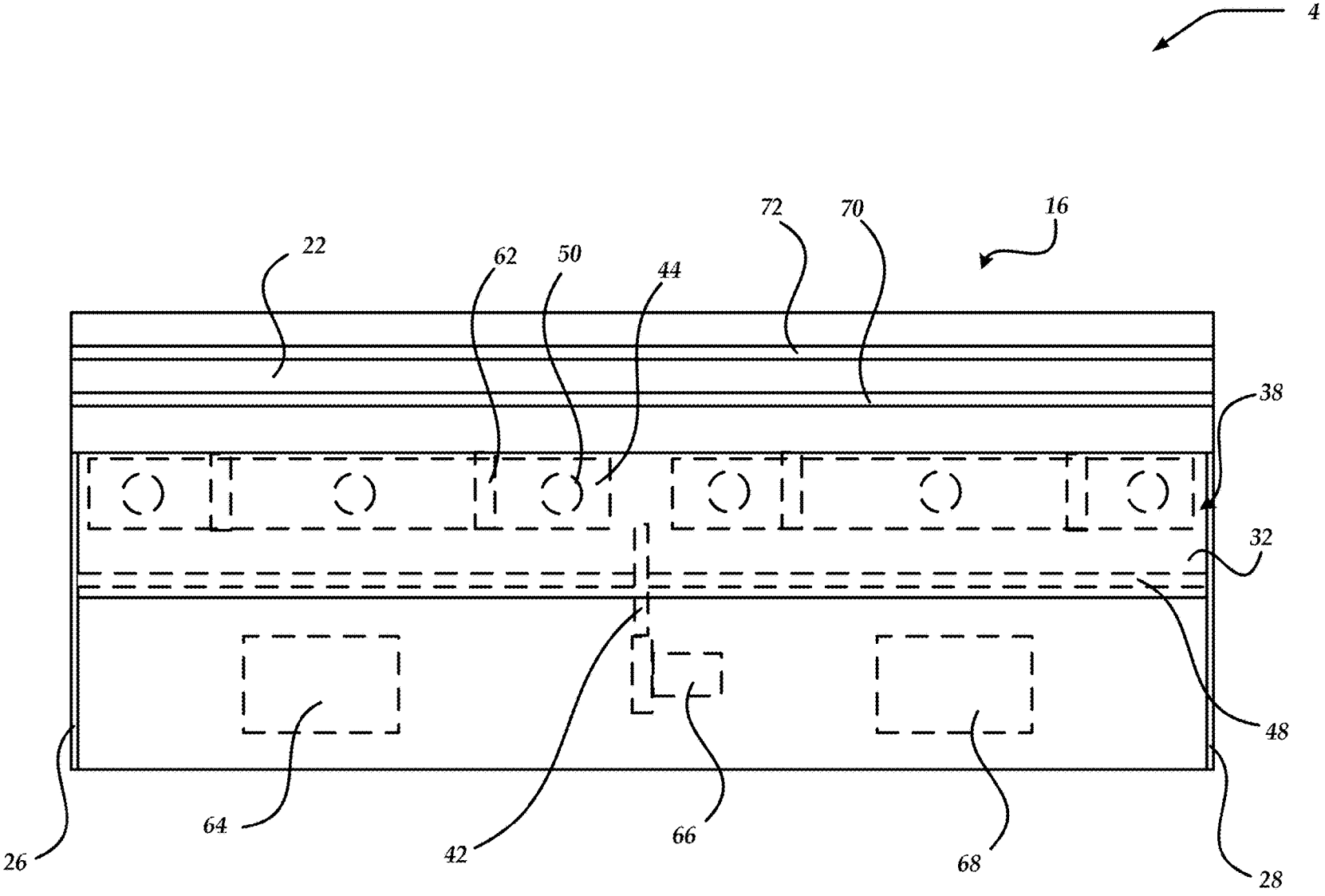
FIG. 12 is a transparent overhead schematic plan view of the spike-strip module of FIG. 10 in the undeployed configuration.

In some versions, the spike platform 44 is not directly coupled to the actuator that drives the door 32, 34. The spike platform 44 is preferably coupled to an elevating mechanism 50, such as a piston or coil spring around a telescoping rod that couples the spike platform 44 to the floor of the housing 16, 18 to prevent the spring from deforming away from its longitudinal axis. The elevating mechanism 50 preferably biases the spike platform 44 toward the deployed configuration with more force than it takes to puncture a typical passenger vehicle tire, thereby preventing the fleeing vehicle from depressing the elevating mechanism 50 in a manner sufficient to avoid puncturing. A depressor 62, such as a fin, preferably extends downward from the door 32, 34 and is configured to depress the spike platform 44 into the undeployed configuration as the door 32, 34 transitions to the closed configuration (see FIG. 10) and to allow the spike platform to transition to the deployed configuration as the door 32, 34 transitions to the open configuration (see FIG. 11). As shown in FIG. 12, multiple spike platforms are preferably disposed in a row in the housing, and each of spike platform is preferably supported at multiple points by the mechanism that lifts it, such as the elevating mechanism 50 (represented by the circles in hidden lines in FIG. 12) or the actuator such as the pinion 42 (for example, multiple actuators may be disposed along the length of the axle 48). In some versions, multiple fins such as the fin 62 are disposed along the length of the door 32, 34, as represented by the thin rectangles in hidden lines along the length of the door 32, 34 in FIG. 12.

As shown in FIG. 12, at least one of the spike-strip modules 4, 6 in the spike strip 2 has a power source 64 that provides power to a mover 66 such as a servo connected to the pinion 42 by an axle or gear (represented by a rectangle in hidden lines in FIG. 12), control circuitry 68, and any other electrical components of the spike strip 2, such as warning lights 70-76 (see FIG. 1). The power source 64 is preferably rechargeable through a USB port (not shown) disposed in the housing 16, 18. Power and control signals are preferably transmitted from the power source 64 and the control circuitry 68 from the left spike-strip module 4 to the right spike-strip module 6 through one or more of the tethers 12, 14. In other versions, each spike-strip module 4, 6 includes its own control circuitry or its own power source. Accordingly, the power source 64 is preferably electrically coupled to the control circuitry 68, which is electrically connected to the mover 66 and the warning lights 70, 72 and, in some versions, to a corresponding mover in the spike-strip module 6 and to the warning lights 74, 76.

Figure 13:
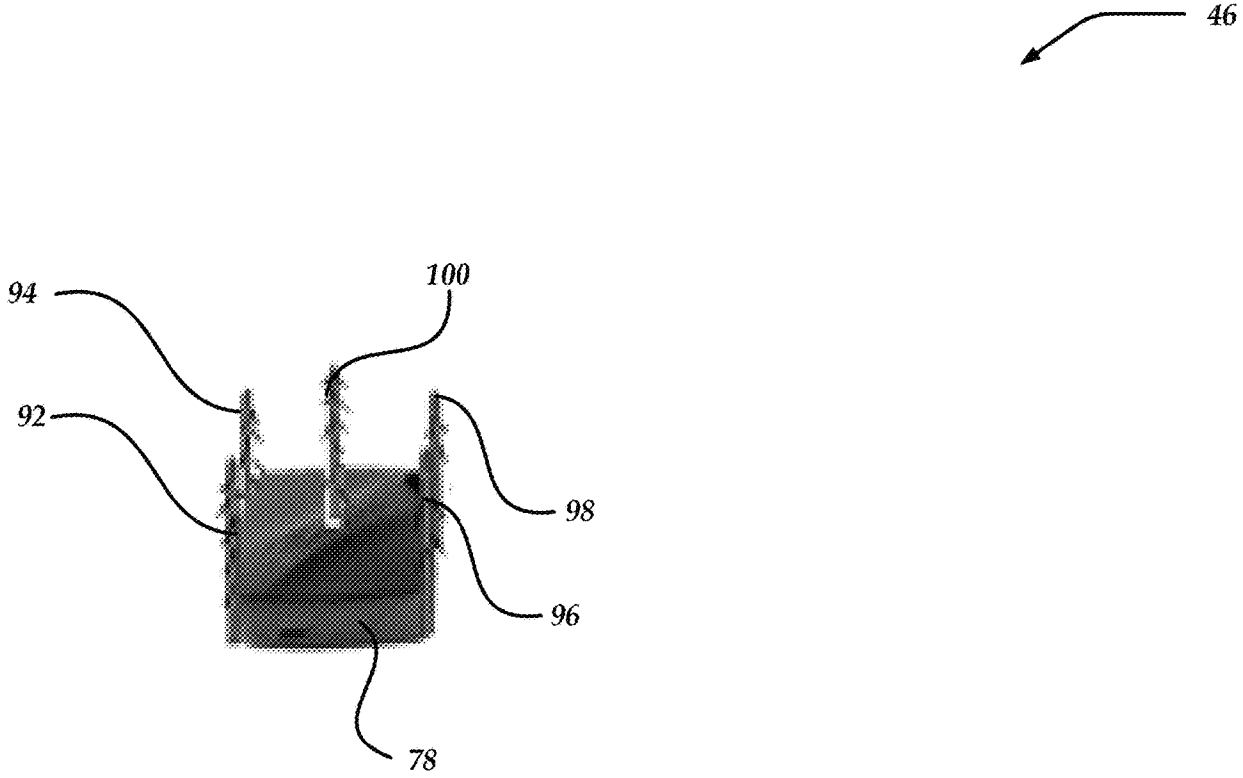
FIG. 13 is perspective view of a preferred spike-tracker assembly.

A preferred spike-tracker assembly 46 is shown in FIG. 13. The assembly 46 preferably includes a tracker 78 and multiple spikes 92-100 coupled to and extending upward from the tracker 78. The spikes 92-100 are preferably configured to puncture a vehicle's tire and are preferably hollow to promote deflation of the tire. The spikes 92-100 are preferably sufficiently secured to the tracker 78 such that the tracker 78 remains fixed relative to the punctured tire as the vehicle continues to drive at high speed. The spikes 92-100 are preferably integral to the tracker 78 or fastened to or adhered to the tracker 78. Multiple spike-tracker assemblies that are the same as or similar to the spike-tracker assembly 46 are preferably disposed in at least one row along the length of each spike platform in each spike-strip module 4, 6. Accordingly, the spike strip 2 is configured to case multiple spike-tracker assemblies to puncture and adhere to the vehicle tire. As a result, the vehicle will be trackable as long as one spike tracker of the assemblies remains secured to the spikes that punctured the tire.

In some versions, the spike-tracker assemblies are disposed on rocker bottoms (not shown) that facilitate the spikes and corresponding spike trackers rocking on the platforms as the fleeing vehicle drives over the spike strip 2 to decrease damage incurred by the spike-tracker assemblies. As shown in the drawings, the spikes 20 are oriented substantially vertically in the deployed configuration. In some versions, the spikes 20 are oriented at approximately 40-55 degrees from vertical toward the ramp region to facilitate increasing the likelihood of puncturing the tires of the fleeing vehicle.

The tracker 78 preferably includes a durable housing that facilitates protecting the components internal to the housing when repeatedly hitting the pavement and then pressed between the punctured tire and the pavement of the road as the vehicle with the punctured tire drives away from the spike strip 2. The internal components of the tracker 78 preferably include a power supply and a global positioning system (GPS) transceiver that facilitates transmitting the location of the tracker 78 to a computer (for example, mobile device) of the LEO operating the spike strip 2 to allow the LEO to track the car with the punctured tire. In some versions, the tracker 78 includes a passive or active beacon, radio frequency identification (RFID) transponder, or other component that allows the LEO to track the location of the tracker 78, such as by triangulation or other known methods. In other versions, the tracker 78 lacks a location determination system such as a GPS transceiver and instead is configured to transmit a signal that lacks location information to third-party computers within range of the signal, and the signal is configured to cause a receiving third-party computer to send a message to the LEO computer with information identifying the location of the third-party computer. The LEO computer is configured to determine that the tracker 78 is near the third-party computer, such as within a predetermined distance of the third-party computer (e.g., a distance defined by the typical range of the signal, such as a typical range of a signal conforming to a BLUETOOTH standard).

In operation, the LEO removes the spike strip 2 from the LEO's vehicle, transitions the spike strip 2 from the collapsed configuration to the expanded configuration, and lays the spike strip 2 across at least one lane on which a fleeing vehicle is expected to travel. The spike trackers are preferably active trackers that are continuously in the "on" state with their batteries being replaced or charged regularly, such as once every 6 months, year, two years, or three years, depending on the battery life of the trackers. In some versions with active trackers in the spike-tracker assemblies, the LEO preferably transitions all of the trackers to their "on" state prior to laying the spike strip 2 across the at least one lane. In some versions, the control circuitry 68 causes the trackers to transition to their "on" state by, for example, transmitting a control signal to the trackers, causing a component of the spike strip 2 (such as respective arms (such as resilient arm 102 in FIGS. 8-11) disposed along the length of the spike platforms) to manipulate user controls on the trackers. In the versions shown in FIGS. 8-11, the arm 102 is passive and manipulates on/off user controls of the tracker of the spike-tracker assembly 46 responsive to the control circuitry 68 causing the platform 44 to move the spike-tracker assembly 46 past the arm 102. The LEO then moves away from the spike strip 2 to a safe location.

The control circuitry 68 preferably includes a wireless receiver or transceiver (for example, a BLUETOOTH® transceiver) that receives instructions transmitted from a computer (for example, a mobile device) operated by the LEO. Responsive to receipt of a deployment instruction signal from the computer, the control circuitry 68 is preferably configured to transition the spike strip 2 from the undeployed configuration to the deployed configuration. The control circuitry 68 is preferably configured to cause the warning lights 70-76 to illuminate, flash, or change colors responsive to receipt of the deployment instruction signal, completion of transition to the deployed configuration, expiration of a predetermined time period (for example, 5, 10, 15, 20, 25, 30, 45, 60, or more seconds) after receipt of the signal or completion of the transition to the deployed configuration, determination that a spike-tracker assembly separated from its spike platform, or another event to warn drivers of vehicles arriving at the spike strip 2 after the fleeing vehicle. In some versions, each spike platform has two electrodes communicably coupled to the control circuitry 68 with the electrodes disposed at each location that is configured to receive a spike-tracker assembly, and conductive material is adhered to the bottoms of the spike-tracker assemblies to facilitate closing the electrode circuit until the spike-tracker assembly is removed from the spike platform, thereby notifying the control circuitry 68 that the spike-tracker assembly has punctured and been removed by a vehicle tire. The spike platforms preferably secure the spike-tracker assemblies with hook-and-loop mechanisms or with friction fitting in receptacles defined by the spike platforms. In some versions, the lights 70-76 illuminate in a different color based on whether the spike strip 2 is in the undeployed configuration or the deployed configuration or responsive to determination that a spike-tracker assembly separated from its platform.

As evident from the disclosure herein, the spike strip 2 facilitates LEOs to safely track vehicles that otherwise may have proven difficult or impossible to track. The LEO preferably tracks down the fleeing vehicle by following the signals of moving or the farthest trackers, as identified by the LEO's computer that receives the tracker signals from the trackers. Accordingly, the spike strip 2 facilitates the LEO to back off the fleeing vehicle, allowing the driver or other inhabitants of the fleeing vehicle to abandon the now disabled vehicle, and thereby allowing the LEO to safely approach the location of the abandoned vehicle and then use other tools (for example, K9 tracing, drone tracking, or others) to more safely (at least for the public in general) track down the suspects fleeing on foot and increase the likelihood of successful apprehension. Another signal is preferably transmitted to the control circuitry 68, either from the LEOs computer or by manipulating a user control (for example, a button or switch (not shown)) on the spike strip 2, and the control circuitry 68 responds to the signal by causing the spike strip 2 to transition from the deployed configuration to the undeployed configuration. In other versions, the spike strip 2 automatically transitions from the deployed configuration to the undeployed configuration a predetermined amount of time (for example, within 1, 2, 3, 4, 5, 10, or more seconds) after the determination that a spike-tracker assembly separated from its platform. In some versions with active trackers in the spike-tracker assemblies, the LEO preferably transitions all of the trackers remaining in the spike strip 2 to their "off" state. In some versions, the control circuitry 68 causes the trackers to transition to their "off" state by either transmitting a control signal to the trackers or by causing a component of the spike strip 2 (such as respective arms (not shown) disposed along the length of the spike platforms) to manipulate user controls on the trackers. The warning lights 70-76 preferably cease illuminating or flashing responsive to the spike strip 2 transitioning to the undeployed configuration (for example, a button may be pressed or released by the door 32, 34 or one of the spike platforms when the spike strip 2 transitions between the deployed and undeployed configurations) or the collapsed configuration (for example, a button disposed between the spike-strip modules 4, 6 and extending from the side of one of the spike-strip modules 4, 6 toward the other spike-strip module 4, 6 may be pressed or released by one of the spike-strip modules 4, 6 when the spike strip 2 transitions between the expanded and collapsed configurations). The LEO preferably transitions the spike strip 2 to the collapsed configuration and takes the spike strip 2 back to the local law-enforcement station to load new spike-tracker assemblies into the spike strip 2 to replace those that were removed by the vehicle tire. New spike-tracker assemblies are preferably paired with the LEO's computer prior to installation in the spike strip 2. Suitable trackers include beacons available from BLUE CHARM BEACONS under model name "iBeacon" with model number BC063B. Other suitable trackers include trackers available from APPLE under the model name AIRTAG. Suitable software on the LEO's computer to utilize the trackers is available from most manufacturers of such trackers. In some versions, reinforcement housings encapsulate the trackers to provide further protection. In some versions, the LEO's computer is a drone that follows the trackers that are coupled to the fleeing vehicle.

As used herein, the following terms take the meanings explicitly associated herein, unless the context clearly dictates otherwise. The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular. The term "one or more" discloses no more than a single one or more than one, up to and including all.

The terms "front," "forward," "rear," and "rearward" are defined relative to the ramp regions 22, 24 to orient the reader and do not limit the orientation of the spike strip 2 or described component in a given application. The front side of the spike strip 2 faces the left in FIGS. 8-11. The term "transverse" refers to a non-parallel orientation and includes but is not limited to a perpendicular orientation. The term "configured" refers to an element being one or more of sized, dimensioned, positioned, oriented, electrically or mechanically arranged, or programmed to achieve or provide the recited function or result.

The term "approximately" or "substantially" refers to the described value or a range of values that include all values within 5, 10, 20, 30, 40, or 50 percent of the described value. The term "substantially parallel" refers to parallel or within 5, 10, 15, 20, 25, 30, 35, 40, or 45 degrees of parallel. The term "directly coupled" refers to a component that contacts (for example, when bolted) or is welded to another component. The term "indirectly coupled" refers to a component that is coupled to one or more other components that are coupled to a second component or one or more further components that are coupled to the second component. The term "coupled" should be understood to disclose both direct and indirect coupling of components or elements that are described as being coupled to each other. The term "remote location" means a location that is separated and spaced apart from the spike strip 2.

While the preferred embodiment of the invention has been illustrated and described, as noted above, many changes can be made without departing from the spirit and scope of the invention. For example, each disclosure of an element or component preferably having a feature or characteristic is intended to also disclose the element or component as being devoid of that feature or characteristic, unless the principles of the invention clearly dictate otherwise. Accordingly, the scope of the invention is not limited by the disclosure of the preferred embodiments. Instead, the invention should be determined entirely by reference to the claims that follow. Moreover, each feature, characteristic, element, or component described herein may be implemented in combination with one or more other features, characteristics, elements, or components described herein. For example, one or more of the features, characteristics, or elements of one embodiment of the spike strip 2 may be implemented in combination with one or more other features, characteristics, or elements of one or more other embodiments of the spike strip 2 described herein. It should also be noted that the claim dependencies or combinations of elements recited in the claims does not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (for example, "The spike strip of any one of the preceding or subsequent claims . . . "). This disclosure is also intended to disclose the subject matter of any one of the dependent claims, as if it was an independent claim, with or without all or a portion of the subject matter of the original independent claim(s) or any other subject matter disclosed herein.

I claim:

1. A spike strip comprising:

a first housing;

a plurality of first spikes disposed in the first housing;

a first door configured to transition between a closed configuration in which the first spikes are covered and prevented from puncturing tires of vehicles driving over the spike strip and an open configuration in which the first spikes are exposed and allowed to puncture a first tire of a vehicle driving over the spike strip;

a first mover configured to transition the first door from the closed configuration to the open configuration responsive to a signal provided to the spike strip from a remote location; and a plurality of spike trackers coupled to the first spikes, wherein the first spikes are configured to couple to the punctured first tire, the spike trackers being configured to communicate a signal that provides non-location information to a first computer operated by a third-party unaffiliated with a law enforcement agency, the signal being configured to cause the first computer to communicate location information to a second computer operated by the law enforcement agency to facilitate tracking the vehicle having the punctured first tire; and a warning light that is configured to illuminate or flash after the first spikes puncture the first tire of the vehicle to facilitate warning subsequently arriving vehicles, wherein the housing has a side that is inwardly inclined to define a ramp region that is configured to face oncoming traffic and guide vehicle tires toward a top of the housing, the warning light being disposed in the ramp region of the housing.

2. The spike strip of claim 1, further comprising control circuitry that is configured to receive the signal from the remote location, wherein the signal from the remote location is a wireless signal, the control circuitry being configured to cause the first mover to transition the first door from the closed configuration to the open configuration responsive to the wireless signal wherein the spike trackers lack global positioning system (GPS) receivers and GPS transceivers.

3. The spike strip of claim 1, wherein the spike trackers include wireless personal area network or wireless local area network beacons the signal is configured to identify the spike tracker or the second computer to enable the first computer to send the location information to the second computer.

4. The spike strip of claim 1, wherein the spike trackers include beacons that conform to a BLUETOOTH standard.

5. The spike strip of claim 1, further comprising a warning light that is configured to illuminate or flash after the first spikes puncture the first tire of the vehicle to facilitate warning subsequently arriving vehicles.

6. A spike strip comprising:

a first housing;

a plurality of first spikes disposed in the first housing;

a first door configured to transition between a closed configuration in which the first spikes are covered and prevented from puncturing tires of vehicles driving over the spike strip and an open configuration in which the first spikes are exposed and allowed to puncture a first tire of a vehicle driving over the spike strip;

a first mover configured to transition the first door from the closed configuration to the open configuration responsive to a signal provided to the spike strip from a remote location; and a plurality of spike trackers coupled to the first spikes, wherein the first spikes are configured to couple to the punctured first tire, the spike trackers being configured to communicate a signal to a first computer on a drone that is configured to follow the spike trackers, the signal being configured to cause the first computer to communicate location information to a second computer to facilitate tracking the vehicle having the punctured first tire.

7. The spike strip of claim 6, wherein the spike trackers lack global positioning system (GPS) receivers and GPS transceivers.

8. The spike strip of claim 6, wherein the signal is configured to identify the spike tracker or the second computer to enable the first computer to send the location information to the second computer.

9. The spike strip of claim 6, further comprising a warning light that is configured to illuminate or flash after the first spikes puncture the first tire of the vehicle to facilitate warning subsequently arriving vehicles.

10. A spike strip comprising:

a base;

a plurality of first spikes coupled to the base and configured to puncture a tire of a vehicle driving over the base; and a plurality of spike trackers respectively coupled to the first spikes, wherein the spike trackers are configured to remain coupled to the first spikes while one or more of the first spikes having one or more of the spike trackers are coupled to the tire of the vehicle, the spike trackers being configured to communicate a signal to a remotely located computer to facilitate tracking the vehicle having the punctured tire.

11. The spike strip of claim 10, wherein the spike trackers lack global positioning system (GPS) receivers and GPS transceivers.

12. The spike strip of claim 10, wherein the spike trackers include wireless personal area network or wireless local area network beacons, and the signal is configured to identify the spike tracker or the remotely located computer to enable the beacons to send the location information to the remotely located computer.

13. The spike strip of claim 10, wherein the spike trackers include beacons that conform to a BLUETOOTH standard.

14. The spike strip of claim 10, wherein the spike trackers include GPS receivers or GPS transceivers.

15. The spike strip of claim 10, further comprising a housing that has the base, the housing having a door configured to transition between a closed configuration in which the first spikes are covered and prevented from puncturing tires of vehicles driving over the spike strip and an open configuration in which the first spikes are exposed and allowed to puncture a first tire of a vehicle driving over the spike strip, the housing having a mover configured to transition the door from the closed configuration to the open configuration responsive to a signal provided to the spike strip from a remote location.

16. The spike strip of claim 10, wherein the spike trackers are configured to communicate the signal to the remotely located computer while the remotely located computer is positioned on a drone that is configured to follow the spike trackers, the signal being configured to cause the remotely located computer to communicate location information to a second computer to facilitate tracking the vehicle having the punctured tire.

17. The spike strip of claim 10, further comprising a warning light that is configured to change states or colors after one or more of the first spikes puncture the tire of the vehicle to facilitate warning subsequently arriving vehicles.

18. The spike strip of claim 17, wherein the base has a side that is inwardly inclined to define a ramp region that is configured to face oncoming traffic and guide vehicle tires toward a top of the base, the warning light being disposed in or along the ramp region of the housing.

* * * * *